United States Patent [19]

Kee et al.

[11] Patent Number: 4,857,008

[45] Date of Patent: Aug. 15, 1989

[54] ELECTRICAL CONNECTOR

[75] Inventors: William C. Kee, Lusk; Patrick M. Brannigan, Templeoque; Cornelius B. Clarke, Dublin, all of Ireland

[73] Assignee: Anner Research and Development Limited, Dublin, Ireland

[21] Appl. No.: 151,402

[22] Filed: Feb. 2, 1988

[30] Foreign Application Priority Data

Feb. 3, 1987 [IE] Ireland ..... 269/87
Sep. 1, 1987 [IE] Ireland ..... 2338/87

[51] Int. Cl.[4] ..... H01R 13/58

[52] U.S. Cl. ..... 439/352; 439/358; 439/447; 439/610

[58] Field of Search ..... 439/350–358, 439/447, 606, 610; 285/90, 91; 403/322, 325

[56] References Cited

U.S. PATENT DOCUMENTS

| | | | |
|---|---|---|---|
| 2,869,095 | 1/1959 | Arson | 439/354 |
| 3,569,908 | 3/1971 | Appleton | 439/352 |
| 4,033,655 | 7/1977 | Sewell | 439/95 |
| 4,557,543 | 12/1985 | McCleerey et al. | 439/246 |
| 4,634,208 | 1/1987 | Hall et al. | 439/610 |
| 4,737,124 | 4/1988 | Ezure et al. | 439/610 |

FOREIGN PATENT DOCUMENTS

| | | | |
|---|---|---|---|
| 0204854 | 5/1966 | Sweden | 285/90 |
| 815762 | 3/1957 | United Kingdom . | |
| 983195 | 3/1963 | United Kingdom . | |
| 955432 | 4/1964 | United Kingdom | 439/606 |
| 2078020 | 7/1981 | United Kingdom . | |

*Primary Examiner*—Gary F. Paumen
*Attorney, Agent, or Firm*—Scully, Scott, Murphy & Presser

[57] ABSTRACT

An electrical, particularly audio male connector comprises an inner insulator member having three contacts mounted therein. A metal shielding shell embraces the insulator member and extends over the contacts to shield against electrical interference. The connections between the contacts and conductors of an audio cable are encapsulated by an outer body moulded around a portion of the shell and the connections. A female connector of similar construction is also described and the male and female connectors are held together on assembly by a latch mechanism comprising a latch member and a biassing spring.

6 Claims, 4 Drawing Sheets

ELECTRICAL CONNECTOR

SUMMARY OF THE INVENTION

The invention relates to an electrical connector and in particular to an electrical connector of the plug-and-socket type, particularly for audio and communications applications.

According to the invention there is provided an electrical connector comprising:

an inner insulator member;

a plurality of contacts mounted in the insulator member;

each contact having a forward end for mating with a complementary contact of another connector and a rear end including means for attachment to a conductor of a multi-core cable;

a shielding shell embracing the insulator member and extending over the contacts; and an outer body of insulating material moulded around a portion of the shell, the rear end of the contacts and the conductors, encapsulating the connections between the conductors and the contacts so that the connector is non-rewirable.

In one embodiment of the invention the shielding shell includes engagement means for engagement with the outer moulded body.

In one case the engagement means comprises an outer rearwardly inclined wedge surface on the shell. Alternatively or additionally the engagement means comprises a circumferentially extending groove for engagement with the outer moulded body.

Preferably the outer moulded body is of a flexible plastics material.

In a particularly preferred embodiment of the invention the outer body of insulating material is moulded around a portion of the cable to define a cable strain and flexure relief.

In one embodiment of the invention the outer moulded body is formed with a plurality of integrally moulded finger grips.

In a preferred embodiment of the invention the inner insulator member comprises a plastic member having a plurality of bores which receive said contacts. Preferably the contacts are loosely mounted in the insulator member bores to permit transverse movement of the contact for mating engagement with complementary contacts.

In one embodiment of the invention means for attaching a contact to a conductor of a multi-core cable comprises double crimp lugs provided on the contact which are bent over to engage the conductor. Alternatively the contacts are of hollow construction and include solder pots for soldering the conductors of the cable to a contact.

In another embodiment of the invention one of the contacts comprises a grounding contact which, on assembly, is in electrical contact with the shielding shell for grounding the connector.

Alternatively means are provided for connecting a ground wire of a cable to the shielding shell. Preferably the shell includes a bore to which the ground wire is connected and soldered in place.

The shielding shell may be of a die-cast metal. Alternatively, the shielding shell comprises a deep drawn metal component.

Preferably the outer surface of the shielding shell is formed with a finger gripping means.

The invention also provides an electrical connector assembly comprising: a male connector and a female connector, means for locating one connector relative to the other for mating engagement, and means for engaging the connectors one with the other, the male connector comprising:

an inner insulator member;

a plurality of male contacts mounted in the insulator member;

each male contact having a forward end and a rear end including means for attachment to a conductor of a multi-core cable;

a shielding shell embracing the insulator member and extending over the contacts; and an outer body of insulating material moulded around portion of the shell, the rear end of the contacts and the conductors, encapsulating the connections between the conductors and the contacts so that the connector is non-rewirable, the female connector comprising:

an inner insulator member;

a plurality of female contacts mounted in the insulator member;

each female contact having a forward end for mating with the forward end of the corresponding male contact of the male connector, and a rear end including means for attachment to a conductor of a multi-core cable;

a shielding shell embracing the insulator member and extending over the contacts; and an outer body of insulating material moulded around portion of the shell, the rear end of the contacts and the conductors, encapsulating the connections between the conductors and the contacts so that the connector is non-rewirable.

The locating means may comprise a polarising groove formed on the inner bore of one shielding shell and a polarising key formed in the shielding shell of the other connector, the key engaging in the polarising groove on mating engagement between the connectors.

Preferably the engaging means comprises a latch mechanism. The latch mechanism preferably comprises a latch member and a latch biasing spring for the latch member, the latch member having a catch which is spring biased by the latch spring into engagement with a complementary receiver formed in the shielding shell of another connector and a finger engaging portion for overcoming the biasing of the latch spring to release the catch from the receiver.

Preferably, the latch spring comprises a leaf spring disposed underneath the latch member.

The latch member preferably includes pivot slot for insertion and withdrawal of the latch member into and out of a recess defined in the shielding shell of one of the connectors after insertion of the insulating member into the shielding shell.

The insulator member of the female socket connector is usually formed with an integral spring biasing means for positive engagement between the connectors.

In a particularly preferred embodiment of the invention the connector assembly includes secondary engagement means for preventing operation of the primary engagement means to prevent unauthorised or accidental disconnection.

In a preferred embodiment of the invention the secondary engagement means comprises an abutment between the latch member and the recess, the abutment being movable from a locking position in which movement of the latch member into the recess is restricted or prevented, to a release position in which movement of the latch member is not interfered with.

Typically the abutment is rotatably movable relative to the latch member from the locked to the release position.

Preferably the abutment is provided by a screw. The screw typically is threaded through a hole in the latch member.

The invention will be more clearly understood from the following description thereof given by way of example only with reference to the accompanying drawings in which:

DETAILED DESCRIPTION OF THE PREFERRED EMBODIMENT

Figure 3:
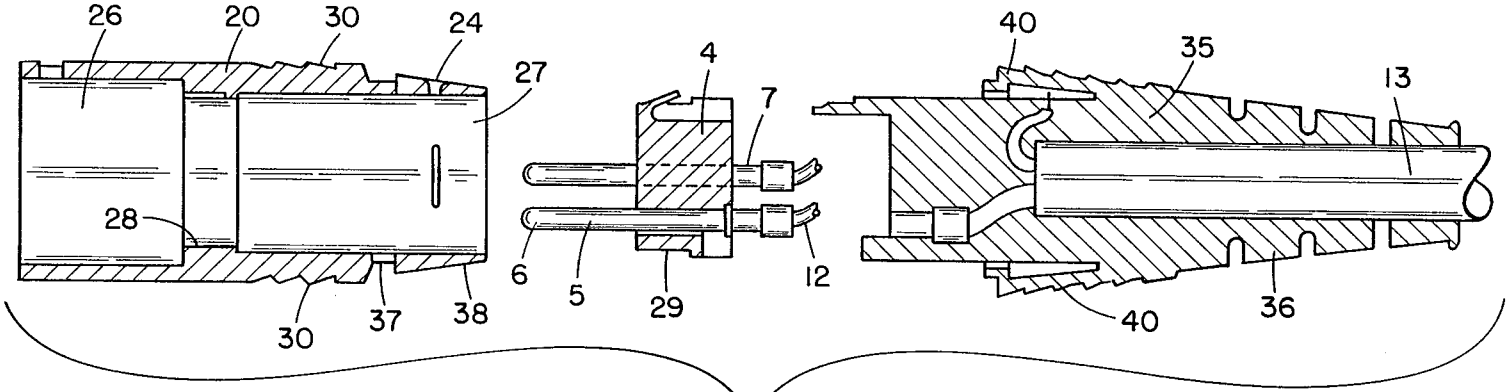
FIG. 3 is an exploded cross-sectional view of the connector of FIG. 1.
Figure 1:
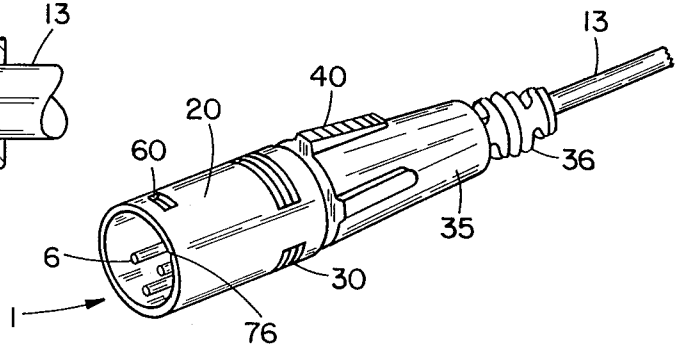
FIG. 1 is a perspective view of a male connector according to the invention.
Figure 2:
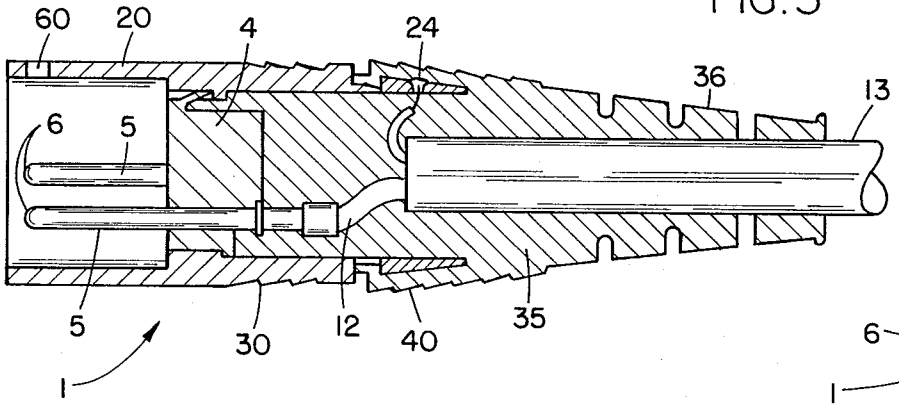
FIG. 2 is a longitudinal cross-sectional view of the connector of FIG. 1.
Figure 6:
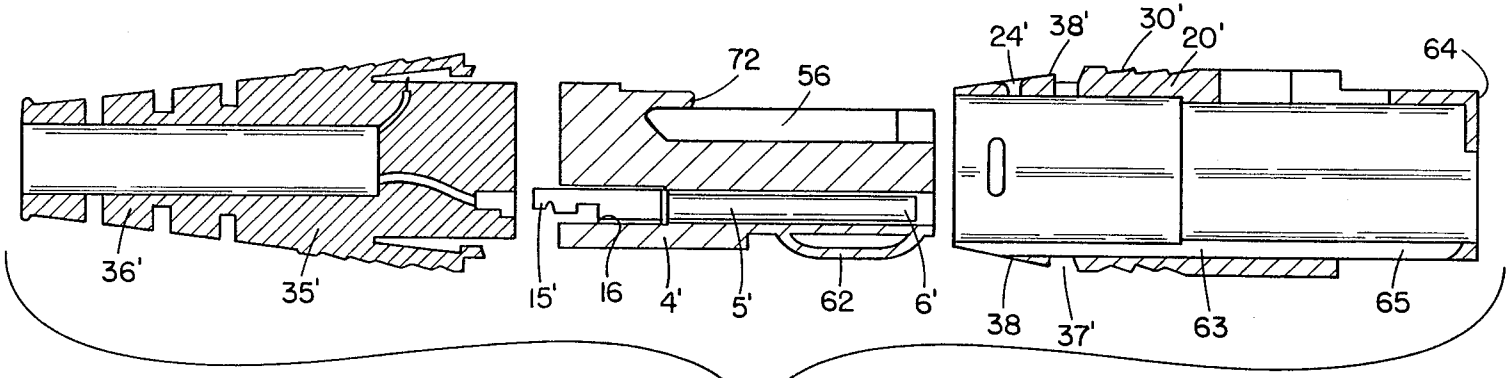
FIG. 6 is an exploded view of the connector of FIG. 4.
Figure 5:
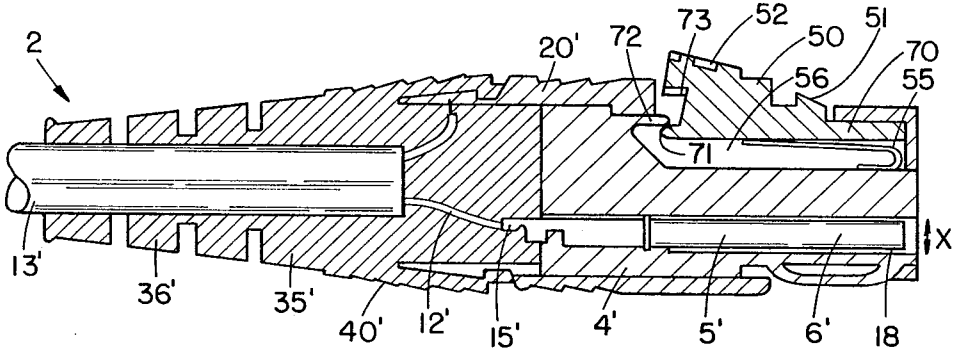
FIG. 5 is a longitudinal cross-sectional view of the connector of FIG. 4.
Figure 4:
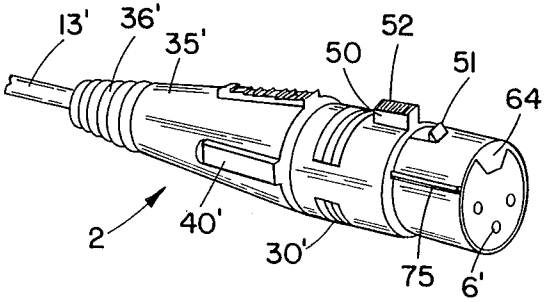
FIG. 4 is a perspective view of a female connector according to the invention.
Figure 8:
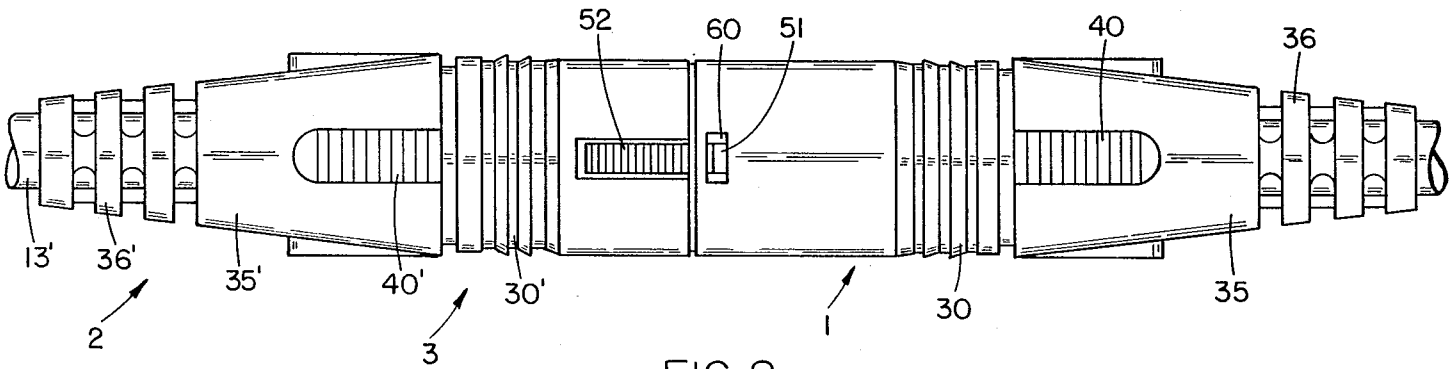
FIG. 8 is a longitudinal cross-sectional view of the assembly of FIG. 7.
Figure 9:
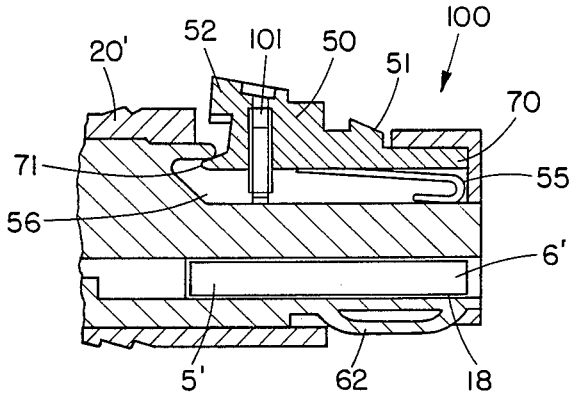
FIG. 9 is a cross-sectional view of a portion of a connector according to another embodiment of the invention.

Referring to the drawings there is illustrated in FIGS. 1 to 3 a male audio connector indicated generally by the reference numeral 1. A female connector also according to the invention is indicated generally by the reference numeral 2 and is illustrated in FIGS. 4 to 6. An electrical connector assembly, also according to the invention, and comprising the male connector of FIGS. 1 to 3 and the female connector of FIGS. 4 to 6 is illustrated in FIGS. 8 and 9 and is indicated generally by the reference numeral 3.

Referring particularly to FIGS. 1 to 3, the male audio connector 1 comprises an inner insulator member 4 having a plurality of male contacts, in this case three male contacts 5 mounted therein. Each of the contacts 5 has a forward plug end 6 for mating with a complementary contact of the female connector 2 and a rear end 7 including means for attachment to one conductor 12 of a multi-core audio cable 13. In this case the contact 5 is connected to a bared end of the conductor 12 by a double crimped lug arrangement.

A metal shielding shell 20 embraces the insulator member 4 and extends in use over the contacts 5 including the connections to the conductor 12 of the cable 13 to shield the contacts and connections from outside electrical interference. The shell 20 may be of a die-cast metal such as zinc or may be a deep-drawn component.

The shielding shell 20 includes a forward enlarged diameter portion 26 and a reduced diameter rear portion 27 into which the insulator member 4 with the contacts 5 in place is inserted. A shoulder 28 separates the front 26 and rear portion 27 of the shell 20 and in use the shoulder 28 engages with a step portion 29 of the insulator member 4 to locate the insulator member 4 in position in the shell and provide shut-off during encapsulation.

The outer surface of the shell 20 is formed with a plurality of circumferentially extending grooves 30 which define finger-gripping portions.

The shell 20 includes a hole 24 to which a wire from the ground wire of the cable may, if desired, be attached and held in position by solder.

The connections between the contacts 5 and the conductors 12 of the cable 13 are encapsulated by an outer body 35 of flexible plastic P.V.C. material which is moulded around a portion of the rear 27 of the shell 20 and the connections between the conductors 12 and contacts 5. In this case the outer moulded body 35 is also moulded around portion of the cable 13 to define a cable strain and flexure relief 36.

It will be noted that the rear portion 27 of the shell 20 is formed with key means in this case comprising a circumferential groove 37 and a rearwardly inclined wedge surface 38 for engagement with the moulded body. The moulded body 35 is also formed with a plurality of substantially wedge-shaped longitudinally extending finger grips 40.

Referring to FIGS. 4 to 6 the female connector 2 according to the invention is similar to the male connector described above with reference to FIGS. 1 to 3 and like parts are assigned the same reference numerals, which are dashed. An outer crimping lug 15′ is bent over the insulator of the conductor 12 to retain it in position. It will be noted that each of the contacts 5′ is formed with one or more barbs 16 which engage in an enlarged portion of a bore 18 in which the contacts are mounted. The contacts 5′ are loosely fitted into the insulator member 4′ to allow the contacts to move a short distance as illustrated in FIG. 5. This loose fit facilitates mating engagement with complementary male spigot contacts 5 of the male connector 1 described above with reference to FIGS. 1 to 3, or any other standard male connector.

Latch means for retaining the male and female connectors together is in this case provided by a latch member 50 having a forward catch portion 51 and push-button 52. Biasing means for retaining the latch member 50 in the raised position illustrated in FIG. 5 is provided by a leaf spring 55 which is housed in a groove 56 of the insulator member 4′. As will be apparent from FIGS. 12 to 13, on engagement of the male and female connectors together, the catch 51 engages in a receiver 60 formed adjacent to the forward end of the shielding shell 20 of the male connector to latch the connectors 1,2 together.

To release the connectors the push-button 52 is depressed to overcome the biasing of the spring 55 and release the catch 51 from the receiver 60 and allow the connectors to be separated. The insulator member 4′ of the female connector 2 is also formed with an additional plastic spring 62 which in use engages against the inner surface of the shell 20 of the male connector 1 to ensure positive engagement between the connectors 1,2. As will be apparent from FIGS. 6 to 11 the shell 20′ of the female connector 2 includes a longitudinally extending keyway 63 along which the spring 62 travels on assembly of the insulator member 4' into the shell 20'. When the insulator member 4 has been inserted up to a forward locating nose portion 64 of the shell 20' the spring 62 projects through a groove 65 in the shell 20' to engage, on assembly, against the inner surface of the shielding shell 20 of the male connector 1.

As will be particularly apparent from FIG. 5 the latch member 50 is housed between the metal shell 20' and the groove 56 of the insulator member 4'. The latch member 50 is of metal material and the insulator member 4' is of a plastic, slightly resilient material which allows the latch member to be assembled into the groove 56 after the insulator member 4' has been inserted into the shell 20' by first engaging a forward leg 70 of the latch member 50 underneath the forward portion of the shell 20' and then pushing the latch member 50 downwardly until a rear catch member 71 of the latch member 50 engages underneath a ledge 72 of the insulator member 41. To disengage the latch member 50 from its groove a screw driver or similar implement is inserted underneath a ledge 73 of the latch 50 and the latch member 50 is pried up. The portion of the latch member 50 underneath the rearward edge 73 is defined as the pivot slot.

Locating means for ensuring the correct orientation between the male 1 and the female connectors 2 on assembly is provided by a longitudinally extending polarising key 75 which projects outwardly through the metal shell $20^1$ of the female part to engage in a complementary-shaped polarising groove 76 in the shell 20 of the male part.

Figure 7:
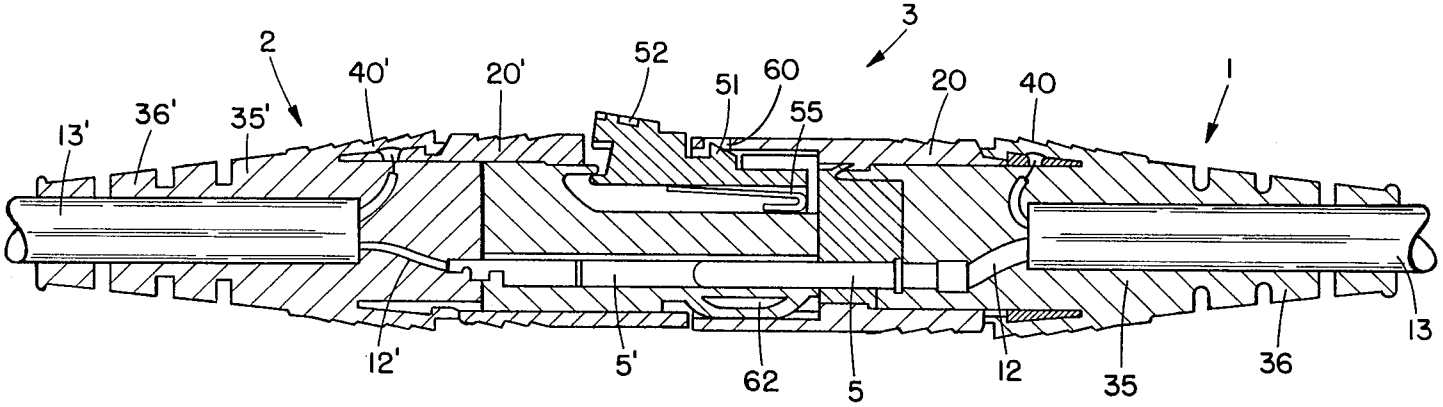
FIG. 7 is a side view of a connector assembly comprising the male connector of FIG. 1 and the female connector of FIG. 4 assembled.

On assembly, and referring particularly to FIGS. 7 and 8 the user turns the connectors 1 and 2 until the polarising key 75 is in alignment with the keyway 76 in which orientation the catch 51 of the latch member 50 is in line with the receiver 60. During assembly the spring 62 is deformed slightly and the spring biasing in the spring 62 ensures good electrical contact between the contact with the male and female connectors and also between the metal shells of the connectors to ensure that the shielding of the contact is maintained at the joint between the connectors 1,2.

By encapsulating the connections between the contacts and the connectors of multi-core cable of this type and providing strain and flexure relief for the cable 13 there is little or no risk of a fault developing at the connections. Thus, in addition to being particularly robust the construction of connectors according to the invention ensure that good electrical contact is maintained between the conductors of the cable and the contacts so that the integrity of the audio system in which the connectors are used is maintained.

Figure 10:
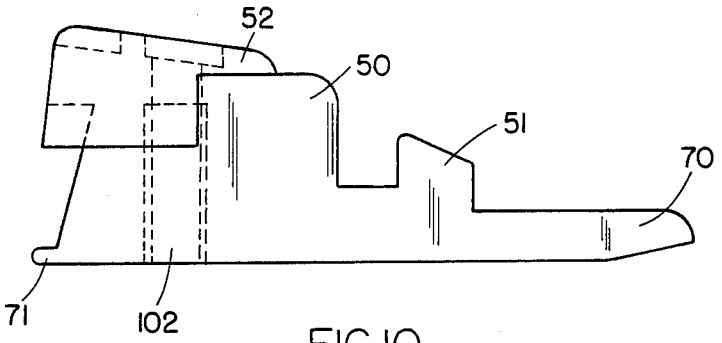
FIG. 10 is a side elevational view of a latch member forming part of the connector of FIG. 9.
Figure 11:
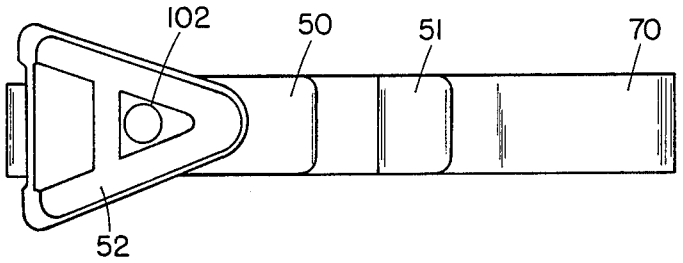
FIG. 11 is a plan view of the latch member of FIG. 10.

Referring to FIGS. 9 to 11 there is illustrated portion 100 of a connector according to another embodiment of the invention in which parts similar to those described with reference to previous embodiments are identified by the same reference numerals. In this case the connector includes a primary engagement means comprising a latch mechanism of the same construction as that described above, particularly with reference to FIGS. 5 and 8, and a secondary engagement means to prevent unauthorised or accidental disconnection. In this case the secondary engagement means comprises a locking means provided by a screw 101 which is threaded through a hole 102 in the latch member 50. The locking screw 101 is movable from a release position in which movement of the latch member 50 is not restricted to a locking position projecting into the recess 56 as illustrated in FIG. 9. In this position the latch member 50 cannot be moved down and hence the connector cannot be disengaged from another connector thus, accidental or unauthorised disconnection is prevented. The screw 101 may be operated by a screwdriver, alan key or the like for movement between the release and locked positions.

The screw 101 may also be extended to prevent the connector from being attached to another connector, if desired, for example, to prevent a connector from being accidentally connected to an amplifier/mixer which is being serviced.

To retard corrosion of the shielding shells, particularly in outdoor use, the shells may be coated with a corrosion resistant Sn/Ni formulation. Similarly, to provide corrosion resistance the terminals may also be coated with a Sn/Ni formulation. Treatment of the terminals in this way will provide more uniform contact resistance over a prolonged period of use.

It will be appreciated that either the male or female connector according to the invention may be used in combination with different components for example, the male connector may be plugged into a female receiver of a main frame audio or video unit.

It will also be appreciated that while the invention has been specifically described with reference to connectors for use with audio equipment it is envisaged that they may have applications in other areas.

It will further be appreciated that the shielding shells used in connectors according to the invention may be of any suitable material. For example, instead of die-cast metal they may comprise a deep-drawn metal component or sintered metal.

It will also be appreciated that while the double crimped lugs are particularly useful in ensuring good connection between the conductors and the contacts any suitable type of connection may be employed, for example, the contacts may comprise hollow or solid pins having solder pots to which the bared ends of the conductors are soldered.

It will be appreciated that the indicating means may be provided to differentiate between the pins. For example, the outer face of the male insert 4 may be marked with appropriate numerals adjacent the corresponding hole for the pin. The end face may also be provided with an advertising logo.

It will also be appreciated that, if desired, separate grounding terminals mounted in the outer body of the male and female connector may be used to make grounding electrical contact between the shells rather than attaching the grounding wire directly to the shell.

We claim:

1. An electrical connector assembly comprising: a male connector and a female connector, means for locating one connector relative to the other for mating engagement, and means for engaging the connectors one with the other, the male connector comprising:

an inner insulator member having a plurality of axially extending bores;

a plurality of male contacts mounted in the bores of the insulator member;

each said male contact having a forward end and a rear end including means for attachment to a conductor of a multi-core cable;

a longitudinally extending shielding shell having a forward portion embracing the insulator member and a rearward portion extending rearwardly over the male contacts; and an outer body of insulating material moulded around the rearward portion of the shell, the rear end of the contacts and the conductors and a portion of the cable, encapsulating the connections between the conductors and the contacts and defining a cable strain and flexure relief so that the connector is non-rewirable, the female connector comprising:

a second inner insulator member having a plurality of axially extending bores;

a plurality of female contacts mounted in the bores of the second insulator member;

each said female contact having a forward end for mating with the forward end of the corresponding male contact of the male connector, and a rear end including means for attachment to a conductor of a second multi-core cable;

a second longitudinally extending shielding shell having a forward portion embracing the second insulator member and a rearward portion extending rearwardly over the female contacts; and a second outer body of insulating material moulded around the rearward portion of the second shell, the rear end of the female contact and the conductors and a portion of the second cable, encapsulating the connections between the conductors and the contacts and defining a cable strain and flexure relief so that the connector is non-rewirable;

the locating means comprising a polarising groove formed on the inner bore of one said shielding shell of said one connector and polarising key formed in the shielding shell of the other connector, the key engaging in the polarising groove on mating engagement between the connectors;

the engagement means comprising a latch mechanism partially housed in a recess in one said connector, the latch mechanism comprising a latch member and a latch biasing spring for the latch member, the latch member having a catch which is spring biased by the latch spring into engagement with a complementary receiver formed in the shielding shell of the other connector and a finger engaging portion for overcoming the biasing of the latch spring to release the catch from the receiver and the connector assembly includes secondary engagement means for preventing operation of the latch mechanism to prevent unauthorized or accidental disconnection of the connectors.

2. A connector assembly as recited in claim 1 wherein the latch member includes a pivot slot for insertion and withdrawal of the latch member into and out of a recess defined in the shielding shell of one of the connectors after insertion of the insulating member into the shielding shell.

3. An assembly as claimed in claim 1 wherein the secondary engagement means comprises an abutment between the latch member and a recess defined in the shielding shell of one of the connector members, the abutment being movable from a locking position in which movement of the latch member into the recess is restricted or prevented, to a release position in which movement of the latch member is not interfered with.

4. An electrical connector as recited in claim 3 wherein the abutment is rotatably movable relative to the latch member from the locked to the release position.

5. An electrical connector as recited in claim 4 wherein the abutment is provided by a screw.

6. An electrical connector as recited in claim 5 wherein the screw is threaded through a hole in the latch member.

* * * * *

UNITED STATES PATENT AND TRADEMARK OFFICE

CERTIFICATE OF CORRECTION

PATENT NO. : 4,857,008

DATED : August 15, 1989

INVENTOR(S) : Patrick M. Brannigan, et al.

It is certified that error appears in the above-identified patent and that said Letters Patent is hereby corrected as shown below:

Column 2, line 53: "includes pivot" should read as --includes a pivot--

Column 7, line 27, Claim 1: "contact" should read as --contacts--

Column 8, line 24, Claim 3: "connector" should read as --connecting--

Signed and Sealed this

Seventeenth Day of July, 1990

*Attest:*

HARRY F. MANBECK, JR.

*Attesting Officer*

*Commissioner of Patents and Trademarks*